United States Patent [19]

Bartrug

[11] 4,188,435

[45] Feb. 12, 1980

[54] LOST END RETHREAD CLIP

[75] Inventor: Norman G. Bartrug, Allison Park, Pa.

[73] Assignee: PPG Industries, Inc., Pittsburgh, Pa.

[21] Appl. No.: 7,081

[22] Filed: Jan. 29, 1979

[51] Int. Cl.[2] ..... B32B 3/30; B65H 57/00

[52] U.S. Cl. ..... 428/167; 57/353; 57/1 R; 28/212; 24/129 R; 242/157 R; 428/542

[58] Field of Search ..... 57/22, 353; 242/157 R, 242/1; 24/129 B, 129 R, 114.5; 28/212, 232; 428/542, 167

[56] References Cited

U.S. PATENT DOCUMENTS

| | | | |
|---|---|---|---|
| 3,434,274 | 3/1969 | Doll | 57/353 X |
| 3,821,543 | 6/1974 | Gelin et al. | 28/212 X |

*Primary Examiner*—George F. Lesmes
*Assistant Examiner*—Alexander S. Thomas
*Attorney, Agent, or Firm*—John E. Curley

[57] ABSTRACT

A flat bodied rethread clip is shown having a plurality of slots adapted to attach thereto running parallel strands. Risers are provided on both sides of the flat body aligned with each of a set of slots so that strands running in the slots will follow the riser into any guides or grooves used to maintain parallel strand spacing.

5 Claims, 3 Drawing Figures

LOST END RETHREAD CLIP

BACKGROUND OF THE INVENTION

In many operations dealing with the manufacture of cords, which are composed of a multiplicity of strands, it is required that parallel strands run through process equipment and that a precise strand count be maintained in the cord product that is being produced. In any such operation it is not uncommon for one or more of the strands, which are to make up the final product cord, to break thereby resulting in an inadequate strand count in the final product. When a strand from a group of parallel strands passing through a given operation breaks, it becomes necessary to rethread the broken strand so that satisfactory product can be produced again.

Thus, for example, in running a plurality of strands through a drying oven to cure coating contained on them, it is conventional practice to rethread a broken strand to adjacent running strands in order to rethread the broken end. This is normally done utilizing a rectangular shaped dog-bone clip fashioned with suitable points of attachment for the running strands and the broken strands. This system works reasonably well when a strand located between two adjacent running strands in a group is broken. However, if an end strand in a given group breaks, difficulties are encountered using the conventional dog-bone lip. This difficulty is caused by the fact that the running strands tend to cause the dog-bone clip to turn from its normal horizontal mode to a vertical one. When the clip passes over the guide equipment such as pulleys utilized to draw parallel running strands through drying ovens, the parallel strands tend to come together and not fall into their proper pulley channel, thus resulting in the production of products which contain too many strands for a given cord product or too few strands for a given cord product.

In U.S. Pat. No. 882,027, filed Feb. 28, 1978, an apparatus for threading moving strands is disclosed which provides some assistance to the skilled artisan in rethreading broken strands in a given operation. While this clip is useful in many instances it suffers one disadvantage if the broken strand is an end strand of a given group. For example, in the production of tire cord utilized in reinforcing rubber tire stock, it is common practice in the industry to feed groups of strands after they have been coated with an elastomeric latex through suitable drying ovens to cure the latex on the glass strands. For a given cord product groups of strands or tows are fed through the oven in parallel positions so that the final product for example, might be a finished cord which has three running strands per cord. If the end strand of a given group of three that will be utilized to manufacture a given cord breaks, utilizing the aforementioned threading clip to rethread, would involve the stopping of an adjacent group of three in order for the broken strand to be threaded in between two running strands. While the two groups of three strands are stopped for this rethreading operation, two production positions are removed from service until the necessary attachment was made which significantly affects overall production efficiency. Thus, there is a need to provide for rethreading broken strands which are contained in any given grouping of strands utilized to make up a single product and which permits only the effected group of strands to be stopped for a rethreading operation. By virtue of the instant invention a rethreading clip suitable for this purpose is provided.

The Invention

In accordance with the instant invention, a rethread clip is provided which is constructed of a flat body portion which is provided with a series of slots on its upper and lower ends. The slots are arranged so that the slots are in alignment with each other in a horizontal direction and in alignment with each other in a vertical direction. The slots provided on the upper and lower ends of the flat body are adapted to engage strands placed in the slots and external ribs or risers are provided on the surface of the body, one riser being provided on each side of the body of the clip between each pair of slots located on the upper and lower end of the flat body. The ribs are provided on both sides of the body and rise vertically from the surface of the flat body a sufficient distance to enable them to run in a pulley channel when they are passed into it during operation. A set of parallel slots are provided on one side of the body located near the top and bottom of the body and each of these slots are aligned with each of the slots provided on the top and bottom of the clip in a horizontal direction and with each other in a vertical direction.

Slots utilized on the top, the bottom and the sides of the rethread clip are provided to correspond to the number of strands being run to provide a given product. Any multiple of slots can be employed. Thus, for example, where the operation requires three threads, two slots are provided on the top and the bottom of the device and a single set of slots are provided on the side. Where the number of strands would be five, four slots would be provided on the top and the bottom with a single set of slots being provided on the end. It has also been found utilizing the instant invention that the utilization of the slots themselves are sufficient and that no tieing of any broken threads are required, the threads simply being inserted in the upper and lower slot of any of the given sets of slots or wound around them for one or more turns being all that is necessary to run the material through the operation being conducted with the clip of the instant invention.

BRIEF DESCRIPTION OF THE DRAWINGS

The strand rethread clip of the present invention will be more fully described with respect to the attached drawing in which.

DETAILED DESCRIPTION OF THE DRAWINGS

Figure 1:
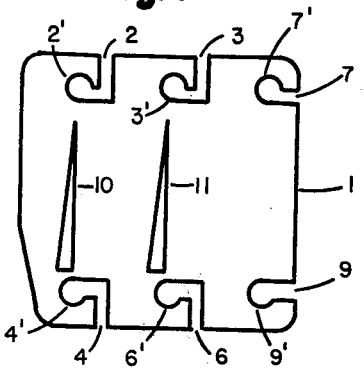
FIG. 1 is a front elevation of the rethread clip of the instant invention.
Figure 2:
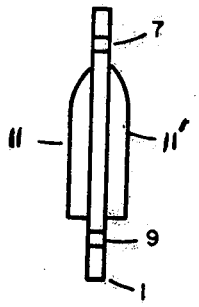
FIG. 2 is a side elevation of the rethread clip of FIG. 1.
Figure 3:
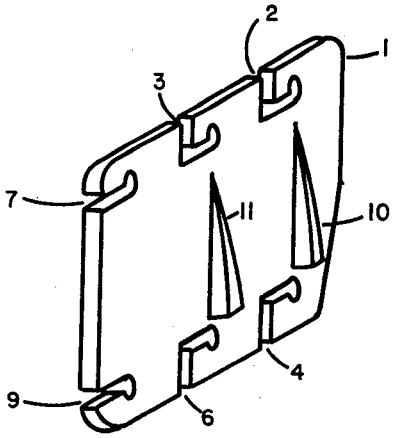
FIG. 3 is a front elevation in perspective of the rethread clip of FIG. 1 to show the ribs in more detail.

As shown in FIGS. 1, 2 and 3, the rethread clip of the present invention is composed of a generally flat body 1 which is provided along its upper surface with two slots 2 and 3, each of slots having an interior curved portion 2' and 3', respectively. The body 1 also is provided on the bottom surface thereof with two further slots 4 and 6 which terminate in the body portion of the clip is curved interior ends of 4' and 6' respectively. Located between the slots 2 and 4 is a rib member 10 and similarly located between slots 3 and 6 is a rib member 11. On the side of the clip 1 are located two further slots 7 and 9 which also terminate in interior curved portions 7' and 9'. Though not shown in the drawing it will be understood by the skilled artisan that the risers 10 and 11 have corresponding risers on the opposite side of body 1. In FIG. 2 the corresponding riser 11' to the riser 11 is shown. As previously mentioned the number of risers and the number of slots provided on the clip 1 will vary depending upon the ultimate number of strands desired in the final product. Thus the rethreading clip shown in the accompanying drawings is designed for a system in which three running strands are utilized to form a given product. Where the number of strands running in a given operation exceeds this number a corresponding number of slots would be provided and a corresponding number of risers would also be provided. There being one less riser than the number of strands running in any given operation.

The clip may be constructed of any suitable material. Particularly useful materials are glass fiber reinforced resins such as polypropylene, nylon, polyester resins, epoxy resins, polycarbonates and the like. The body of the clip can also be constructed of hard rubber, micarta, sheet metal such as steel, brass as well as graphite. The clip can be formed of a single piece of material having the riser and slots formed by molding or stamping techniques. If desired the clip can be multilayered material and the riser can be attached to the flat body as separate pieces.

In utilizing the clip of the instant invention and in conjunction with a operation in which three running strands are being utilized produce a final product, the invention is utilized in the following manner. When the strands running through the operation are interrupted in that operation by a break in one of the three strands, the broken strand is connected to the thread clip by inserting it into one of the slotted members 2, 3, or 7 depending on the location of the broken strand. Assuming the broken strand is in the end portion, i.e. that it is one of the outside ends, the broken thread would be wound around the slots 7 and 9 and held in interior curve portions 7' and 9' of those two slots. The two adjacent running strands are wound around the slots 3 and 6 and 2 and 4 respectively with the strands being contained in the curved portion 3', 6' of the slots 3 and 6 and 2', 4' of the slots 2 and 4. The two strands which were running through the operation when the third one broke, which are still connected to the operation through the clip are then conveyed through the operation which was interrupted by the break and the two running strands contained in the slots 2 and 4 and 3 and 6 will run along side of the broken strand contained in the slots 7 and 9 carrying that strand with them. The risers 10 and 11 have the strands contained in the slots 3 and 6 and 2 and 4 running along the sides of the risers 11 and 10 respectively. It is of course understood that the strands also run along the riser on the opposite side of the body 1 corresponding to risers 10 and 11, i.e., riser 11' shown in FIG. 2. When the threading clip 1 reaches a pulley containing grooves to maintain the strands in parallel, risers 10 and 11 ride in the pulley grooves associated with the strands running along their sides. The riding of risers 10 and 11 in the pulley grooves tends to straighten out the clip which has a tendency to turn because of the pulling force exerted on the risers 10 and 11 by the running strands contained in the slots 2 and 4 and 3 and 6 respectively. When the risers 10 and 11 enter the pulley grooves the strands contained in the grooves 2 and 4 and 3 and 6 fall into their proper channel on the groove and the riser riding in the grooves straightens the clip so that the strand contained in grooves 7 and 9 falls into its proper pulley groove. Thus the clip 1 passes through all of the process equipment riding in the pulley grooves as it passes over them and insures that the strands contained on the surface of the clip fall into their proper spaced relationships with each other by entering the proper pulley groove. At the same time the rethreaded strand contained in the slots 7 and 9 is also placed in its proper place in the pulley groove and back into the operation to produce further cord.

While the invention has been described with reference to certain specific examples and illustrative embodiments it is not limited to be limited thereby except insofar as appears in the accompanying claims.

I claim:

1. A clip for rethreading a broken strand from a group of parallel strands being passed through a process wherein the strands are maintained in spaced parallel relationship during their passage through the process comprising a generally flat body provided with a series of slots on its upper and lower ends; the slots being aligned with each other and adapted to engage strands placed therein, an external rib for each set of slots provided on the external surface of said body and on each side thereof, said ribs being raised from the surface of said body a sufficient distance to enable them to run in a pulley channel when passed into it, a set of parallel slots on one side of said body located near the top and bottom of said body and each of these slots being aligned with the slots provided on the upper and lower end of said body.

2. The clip of claim 1 wherein said body and ribs are constructed of resin.

3. The clip of claim 1 wherein said body and ribs are constructed of a single molded resin blank.

4. The clip of claim 1 wherein the clip is constructed of metal.

5. The clip of claim 1 wherein the clip is constructed of reinforced rubber.

* * * * *